US010052745B2

(12) United States Patent
Carvajal

(10) Patent No.: US 10,052,745 B2
(45) Date of Patent: Aug. 21, 2018

(54) METHOD AND APPARATUS FOR ANCHOR PLACEMENT AND SETTING

(71) Applicant: Anthony Carvajal, Spring Branch, TX (US)

(72) Inventor: Anthony Carvajal, Spring Branch, TX (US)

( * ) Notice: Subject to any disclaimer, the term of this patent is extended or adjusted under 35 U.S.C. 154(b) by 440 days.

(21) Appl. No.: 14/690,546

(22) Filed: Apr. 20, 2015

(65) Prior Publication Data

US 2016/0303730 A1 Oct. 20, 2016

(51) Int. Cl.
*B25B 23/00* (2006.01)
*B25H 1/00* (2006.01)
*B25B 31/00* (2006.01)

(52) U.S. Cl.
CPC ..... *B25B 23/0071* (2013.01); *B25B 31/00* (2013.01); *B25H 1/0035* (2013.01)

(58) Field of Classification Search
CPC ..... B25H 1/0021; B25H 1/0057; B25B 21/0071; B25B 23/0071
USPC ..... 173/32; 408/92, 712; 227/147, 156
See application file for complete search history.

(56) References Cited

U.S. PATENT DOCUMENTS 3,537,336 A * 11/1970 Schmuck ..... B23B 49/006 173/21
3,985,188 A * 10/1976 Steele ..... B25C 7/00 173/170
4,736,804 A * 4/1988 Geibel ..... B25H 1/0035 173/30
5,295,620 A * 3/1994 Cousineau ..... B25H 1/0035 173/170
5,598,892 A * 2/1997 Fox ..... B25F 5/021 173/170
5,820,317 A * 10/1998 Van Troba ..... B25H 1/0035 408/136
7,144,206 B2 * 12/2006 Burger ..... B23B 49/006 408/14
7,237,707 B1 * 7/2007 Wakelin ..... B25C 7/00 173/170
2003/0168491 A1 * 9/2003 Goodwin ..... B25C 7/00 227/147

* cited by examiner

*Primary Examiner* — Nathaniel Chukwurah
(74) *Attorney, Agent, or Firm* — Davis & Associates; William D. Davis

(57) ABSTRACT

An anchor setting apparatus includes an arm, a drill stop, a control actuator, a holster for carrying a drill tool, and linkage for coupling the control actuator to a speed control of the drill tool. The holster and drill stop are coupled proximate one end of the arm. The control actuator is coupled proximate another end of the arm. In various embodiments the length of the arm is variable.

13 Claims, 9 Drawing Sheets

METHOD AND APPARATUS FOR ANCHOR PLACEMENT AND SETTING

TECHNICAL FIELD

This invention relates to the field of construction tools. In particular, this invention is drawn to method and apparatus for anchor placement and setting.

BACKGROUND

Anchors are fasteners used to secure or assist in securing one object to another. For example, an anchor may be used to secure a machine, structure, or part to a supporting surface or structure. Anchors are typically used when screws, nails, and adhesives are inadequate to accomplish the desired fastening. Anchors may be used in conjunction with adhesives, screws, nails, and other mechanical fasteners in order to accomplish the desired fastening. Anchors fall into two primary classes: expansion anchors and hollow wall anchors. An anchor may incorporate features from more than one class.

A hollow wall anchor is designed to be driven through one side of a wall and to expand outside the other side of the wall such that the expanded hollow wall anchor cannot be pulled back through the wall. A hollow wall anchor may be used, for example, to secure picture or picture hanging hardware to a wall.

An expansion anchor expands within the anchoring object it is driven into. Some designs are threaded and expand when a bolt or screw is threaded into them or pulled through them. An expansion anchor may be used, for example, to secure plumbing, electrical conduit, fence, or gate hardware to concrete or brick.

An expansion anchor is inserted into a void or cavity within the anchoring object and then expanded. One prior art method of placing an expansion anchor entails: i) drilling a hole in the anchoring object, ii) placing the anchor within the hole, and iii) "punching" the expansion anchor to cause it to expand within the hole such that it cannot be freely extracted. Performing such operations on a surface other than a floor or a wall within reach of the operator create a number of difficulties for the operator. When the anchor is to be installed within a ceiling, for example, the prior art methods and apparatus present health and safety issues for the operator.

In order to reach the target location for the anchor, the operator often must climb a ladder to drill the hole in the ceiling above him. The ladder inherently confines the operator's ability to move horizontally and the operator's eyes, nose, mouth, and face are in close proximity to drill. The act of drilling causes concrete dust to precipitate down on the operator as a result of gravity. Thus one disadvantage of the prior art method of installing such an anchor is the potential for adverse health consequences to an operator who inhales the concrete dust.

The drill and operation of the drill often require two hands. The operator then uses a punch to strike the anchor to cause it to expand. The punch operation typically requires two hands. The operator then threads another fastener into the anchor. The process of threading the fastener also takes two hands. While on the ladder, the operator must swap tools, drills, or drill bits in order to place and expand the anchor and to thread other fasteners into the anchor. Accordingly, at several points during the process the operator loses the use of one of his hands for holding onto the ladder. Thus another disadvantage of the prior art method of installing such an anchor is the increased the risk of fall and injury for the operator.

SUMMARY

An anchor setting apparatus includes an arm, a holster for carrying a drill tool, a drill stop, a control actuator, and linkage for coupling the control actuator to a speed control of the drill tool. The holster and drill stop are coupled proximate one end of the arm. The control actuator is coupled proximate another end of the arm.

A method of setting an anchor includes utilizing the anchor setting apparatus to set the anchor in a ceiling. The operator places the drill tool in the holster. The operator moves the arm to position the drill tool. The operator activates the drill tool at the distal end of the arm using the control actuator at the end of the arm proximate to the operator to drill a hole in the ceiling. The operator places a punch carrying the anchor on the drill tool and deposits the anchor in the hole. The operator activates the drill tool to set the anchor using the control actuator at the proximate end of the arm.

Other features and advantages of the present invention will be apparent from the accompanying drawings and from the detailed description that follows below.

BRIEF DESCRIPTION OF THE DRAWINGS

The present invention is illustrated by way of example and not limitation in the figures of the accompanying drawings, in which like references indicate similar elements and in which.

DETAILED DESCRIPTION

Figure 1:
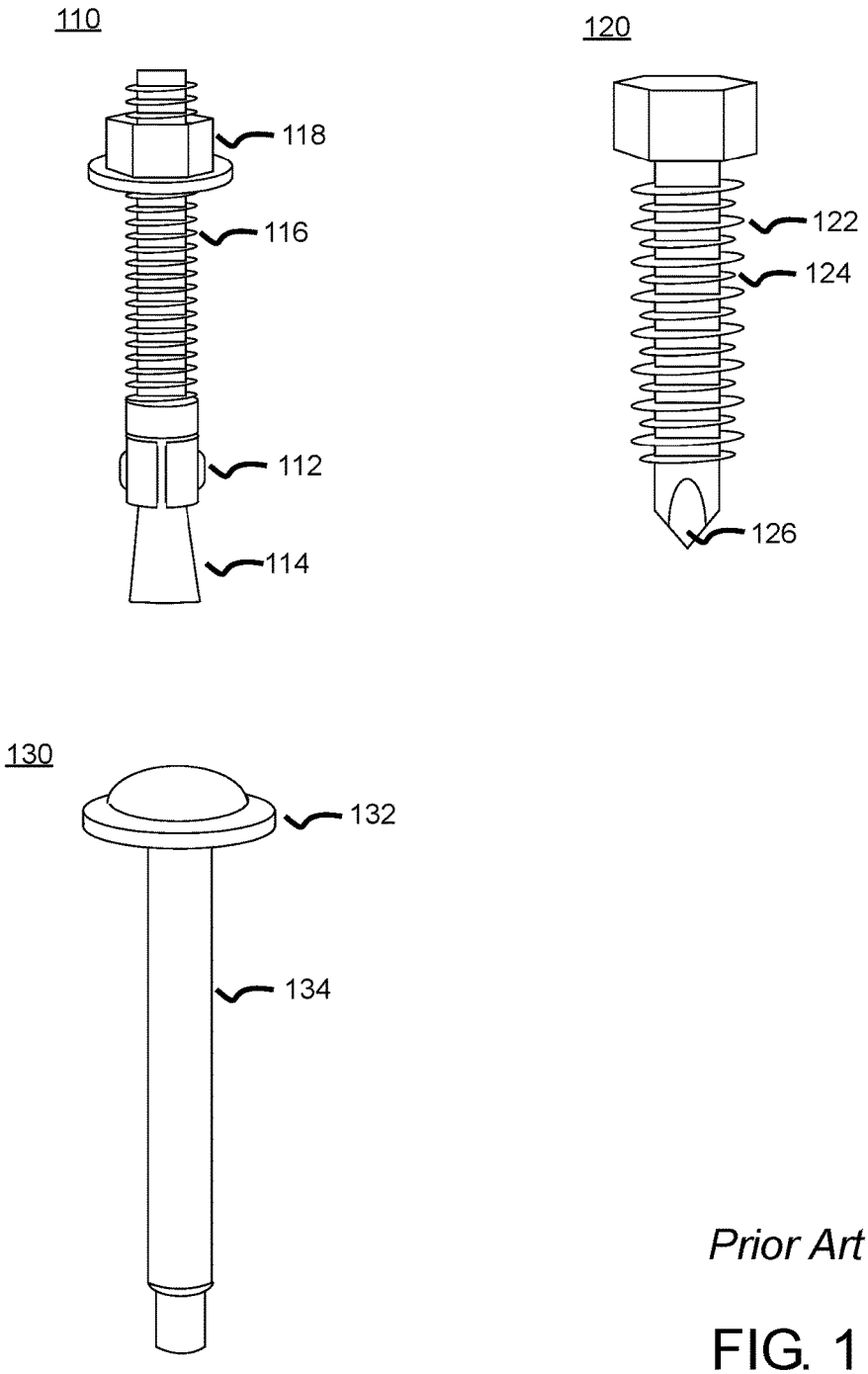
Prior Art FIG. 1
FIG. 1 illustrates anchors that may be secured to an anchoring object through different mechanisms.

FIG. 1 illustrates various prior art anchors 110, 120, and 130. Each of the anchors illustrated in FIG. 1 is characterized as a "male" anchor.

Expansion anchor 110 works by inserting it into a hole drilled into the anchoring material. A ring or clip 112 is designed such that once inserted into a proper sized hole, the clip resists being pulled out again. The clip is expanded by threading the nut 118 on the anchor body 116 and tightening it against the anchoring object. As the nut is tightened against the anchoring object, the conical shaped distal end 114 of the anchor body is drawn into the clip 112 causing it to expand. The expansion anchor is thus expanded, wedging itself securely in the anchoring object. Expansion anchor 110 is also referred to as a "wedge anchor".

Screw anchor 120 relies upon threads that cut into the anchoring material and mechanically interlock with the grooves cut into the anchoring material. For masonry applications, the screw anchor typically has varying sized threads 122, 124 and a self-tapping screw end 126.

Frictional anchor 130 works by driving the frictional anchor from one end 132 into a hole that is slightly smaller than the fastener itself. The frictional anchor has a relatively large surface area 134 and resists being drawn back out of the hole due to frictional forces on the large surface area 134. A nail is another example of a frictional anchor.

Sleeve anchors (not shown) work similar to a wedge anchor. A sleeve anchor is inserted into a hole drilled into the anchoring object. Turning a nut draws the working end of the sleeve anchor up through the sleeve, expanding and anchoring the sleeve anchor securely in the anchoring object. A sleeve anchor is another type of expansion anchor.

Figure 2:
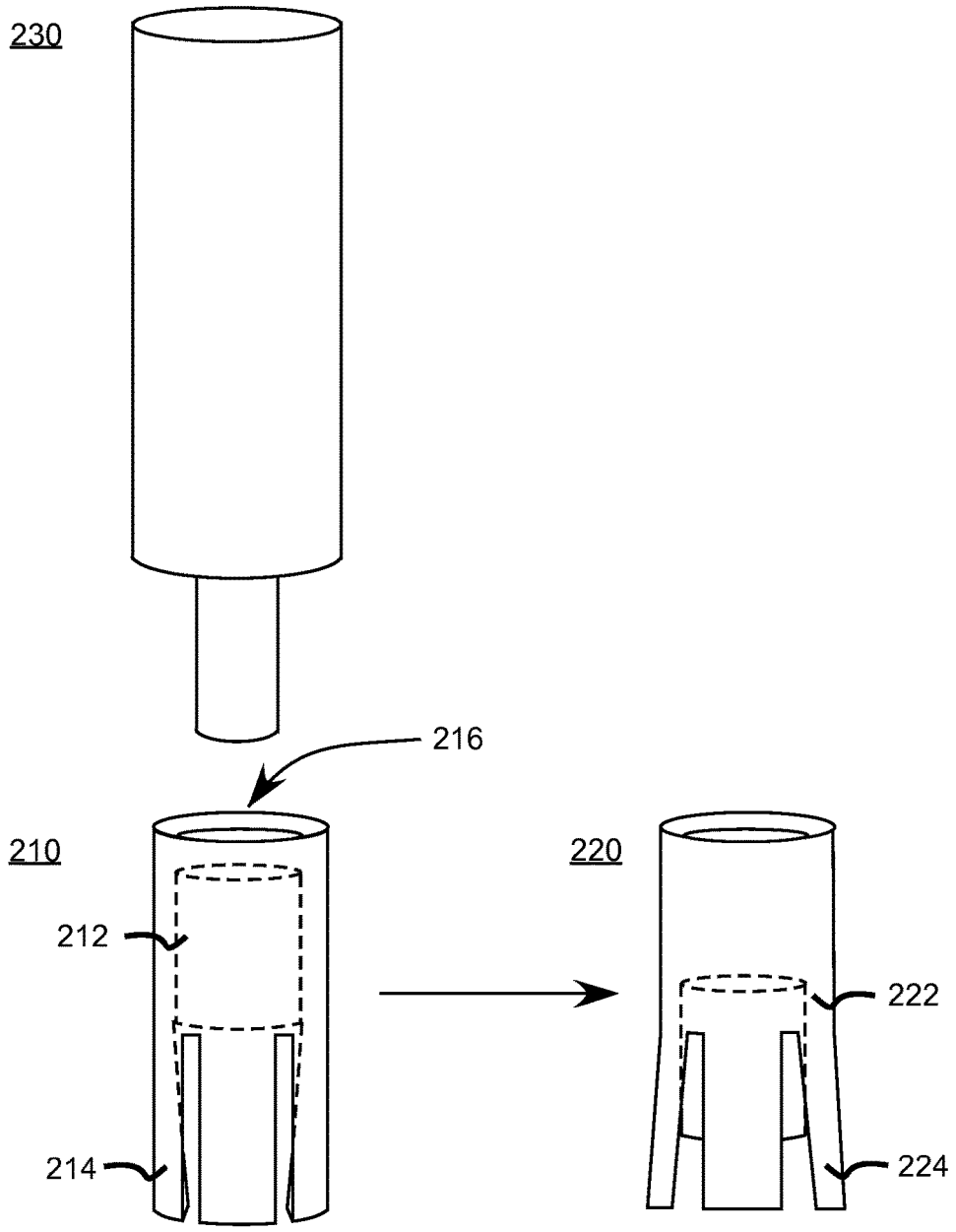
FIG. 2 illustrates one embodiment of a prior art expansion anchor and punch.

FIG. 2 illustrates another embodiment of an expansion anchor 210. The body of expansion anchor 210 is split at one end to form a plurality of deformable legs 214. When closed together the interior surface of the legs form a conical surface within the expansion anchor. The expansion anchor includes an expansion plug 212. In various embodiments the entry 216 into the anchor is threaded such that the internally threaded anchor may be used to retain threaded rods or bolts. Expansion anchor 210 is a female anchor. Expansion anchor 210 is commonly known as a "drop in" anchor.

A bit or punch 230 is used to drive the expansion plug 212 into the conical surface formed by the legs—causing the legs to spread. FIG. 2 illustrates the spreading of the legs 224 resulting from the displacement of the expansion plug 222. Drop-in anchors are well-suited for flush mount applications.

Figure 3:
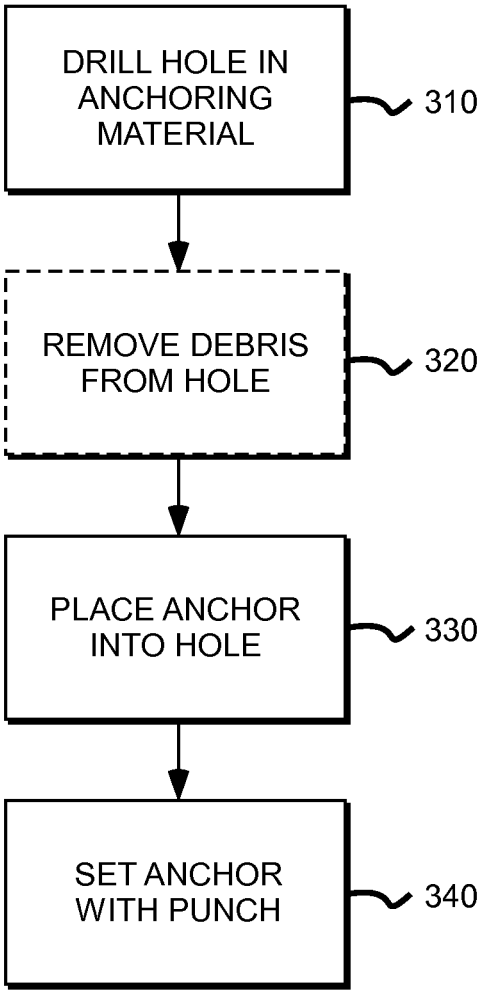
FIG. 3 illustrates one embodiment of a prior art method of installing an expansion anchor.

FIG. 3 illustrates one embodiment of a process for installing an expansion anchor such as a drop in anchor. In step 310 a hole is drilled in the anchoring material. Typically the anchoring material is concrete or brick. Debris is removed from the hole in step 320. Step 320 is illustrated as an optional step because debris removal may not be necessary. In step 330, the expansion anchor is placed within the hole. In step 340, the expansion anchor is set with a punch. Execution of the process of FIG. 3 becomes more problematic for the operator when the expansion anchor needs to be set in a ceiling as opposed to a floor.

Figure 4:
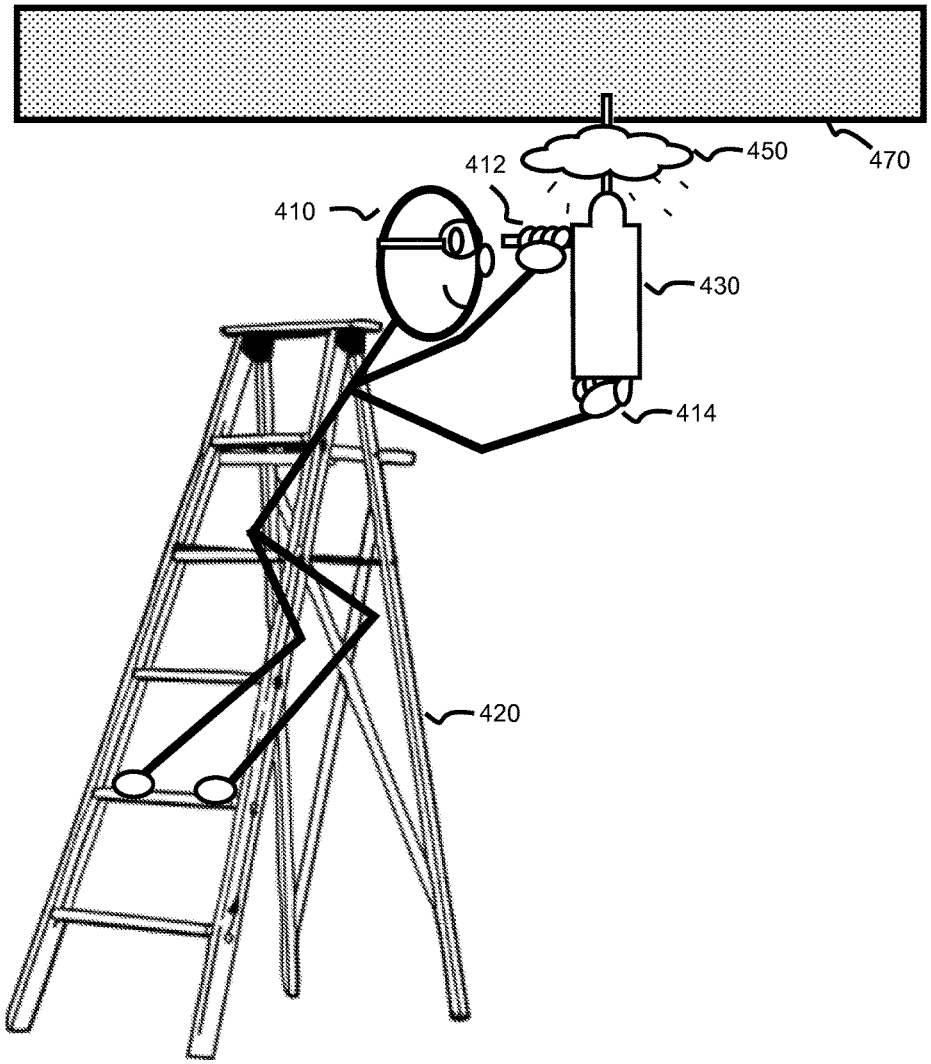
FIG. 4 illustrates one embodiment of execution of method of installing an expansion anchor in a ceiling.

FIG. 4 illustrates prior art method of installing an expansion anchor in anchor material forming a ceiling 470. The operator 410 climbs a ladder 420 to reach the intended location for the anchor. Operating the drill 430 typically takes the use of both arms and hands 412, 414 which leaves the operator with i) fewer than the three points of contact and ii) no point of contact with a hand as required for basic ladder safety. In addition the placement of the drill over the operator and in close proximity to the operator results in precipitation of debris on the operator and increases the operator's risk of inhalation of airborne debris 450. After drilling the hole, the operator must set the drill down and use both hands to place and drive the punch in order to set the anchor. Again, the operator is left with less than three points of contact with the ladder and no point of hand contact with the ladder.

The lack of ladder safety is a problem for the operator as well as the operator's employer and those seeking services provided by the employer and operator. When passing the Occupational Safety and Health Act of 1970, 29 U.S.C. § 15.001, et seq. (the "Act"). Congress declared its intent "to assure so far as possible every working man and woman in the Nation safe and healthful working conditions and to preserve our human resources." The Occupational Health and Safety Act created the Occupational Health and Safety Administration ("OSHA"). OSHA in turn develops regulations to address workplace safety. OSHA has enforcement powers and can impose significant penalties on non-exempt employers.

OSHA has established regulations for when it may act under the "general duty clause" under the Act. The four criteria are i) there must be a hazard; ii) the hazard must be a recognized hazard (e.g., the employer knew or should have known about the hazard, the hazard is obvious, or the hazard is a recognized one within the industry); iii) the hazard could cause or is likely to cause serious harm or death; and iv) the hazard must be correctable. Pursuant to its authority under the general duty clause, OSHA has developed standards for ladder design and use. See, e.g., 29 C.F.R. 1926, Subpart X for regulations relating to stepladders. OSHA has recognized a significant risk of injury or death to workers due to improper ladder use or design. See, e.g., U.S. Dep't of Labor, "OSHA Fact Sheet, Reducing Falls in Construction: Safe Use of Stepladders", Doc. FS-3662, May 2013.) In short, OSHA has recognized that there is a hazard present with the use of ladders, the hazard is an obvious hazard or recognized within the industry (e.g., fall), the hazard can or is likely to cause serious injury or death, and the hazard is correctable.

OSHA recommends a "3 point of contact" procedure when ascending/descending a ladder. This entails always maintaining contact with at least two hands and one foot or one hand and both feet when ascending/descending. Although OSHA recognizes a hazard when ascending or descending, the risk of injury from fall is not diminished when the operator is perched on the ladder but not ascending or descending the ladder. An operator utilizing both arms and hands to hold and operate equipment has no "third point of contact" with the ladder to maintain stability on the ladder or to inhibit a fall from the ladder. Operators using prior art apparatus and procedures for installing anchors are engaging in a hazardous practice that can result in serious injury or death.

Figure 5:
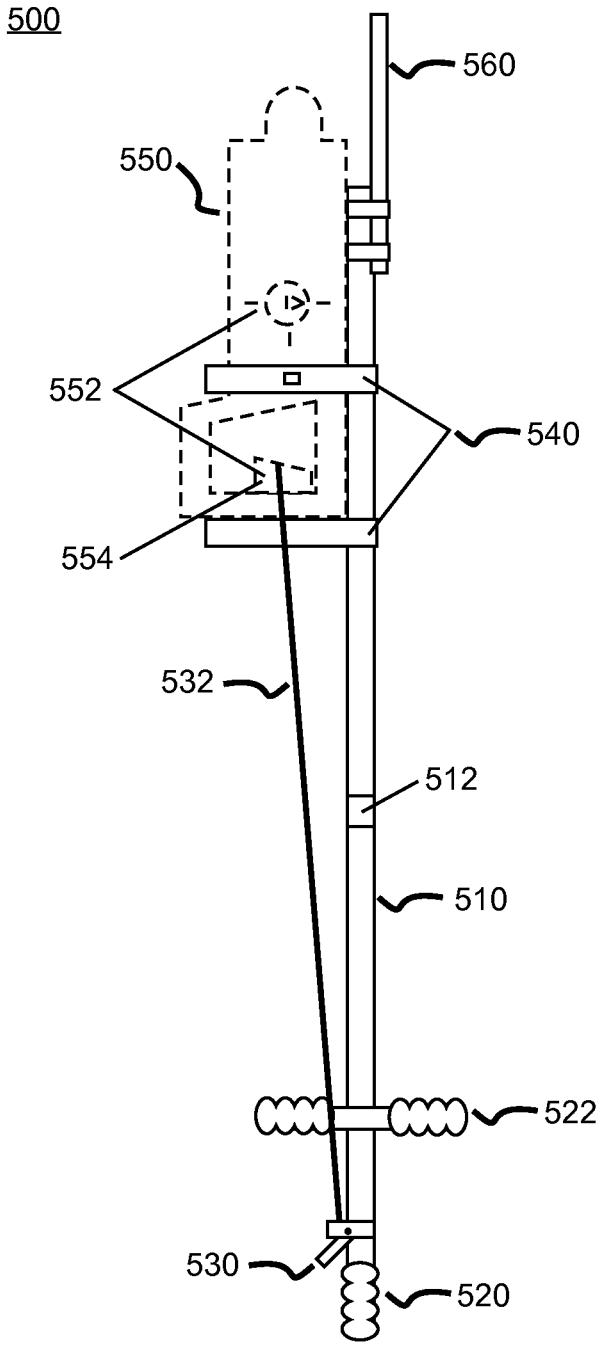
FIG. 5 illustrates one embodiment of an apparatus for placing and expanding anchors.

FIG. 5 illustrates one embodiment of an apparatus 500 designed to improve health, safety, and efficiency associated with placing anchors in elevated locations such as ceilings. The apparatus includes an arm 510. In one embodiment, the arm has an adjustable length. In an alternative embodiment, the arm is fixed in length.

One end of the arm includes a handle 520 and a remote control actuator 530. In one embodiment, the apparatus includes a crossbar handle 522 to provide support for the operator to position and apply the apparatus in locating and setting anchors. The apparatus includes a drill holster 540 for holding a drill tool 550 such as a drill, hammer drill, or rotary hammer. (Hammer drills and rotary hammers are both capable of spinning and pounding a bit but they rely on different apparatus for pounding the bit. A rotary hammer utilizes an air-driven piston to strike the bit. A hammer drill utilizes clicking plates to strike the bit.)

In one embodiment, the apparatus includes a drill stop 560. The drill stop operates to prevent the drill bit from penetrating the anchoring surface beyond a pre-determined depth determined by the relative positions of the drill stop and the bit. In one embodiment, the longitudinal position of the drill stop along the arm is adjustable. In another embodiment, the longitudinal position of the drill stop 560 along the arm 510 is fixed. In one embodiment, the longitudinal position of the drill holster 540 along the arm 510 is adjustable.

The control actuator 530 is linked by linkage 532 to the drill tool's control 552. The control actuator 530 is linked to one or more components of the drill tool's control 552. In various embodiments, linkage 532 is mechanical or electrical in nature depending upon the features or limitations of drill tool 550. At a minimum, the control actuator should be capable of controlling the speed of operation of the drill tool (e.g., via speed control 554).

Adjustable length arms may be realized through the use of arm sections adapted to permit coupling or de-coupling sections to change the length of the arm. For example, arm sections may be adapted for slip coupling (i.e., where the end of one section is flared in order to enable it to receive the end of another section) or threaded coupling. Alternatively, a mechanical sleeve may be utilized to align and retain arm sections. Element 512 illustrates coupling between two arm sections for adjustable length arm embodiments utilizing independent arm sections for length adjustment. In other embodiments, an adjustable length arm is implemented through the use of one or more nested telescoping sections to permit extending (or decreasing) the length of the arm. In such cases, element 512 illustrates a friction lock or other type of locking mechanism to hold a telescoping section in place once a desired length for the arm is reached for adjustable length arm embodiments. Adjustable length arms may also be referred to as extendable arms or extendable length arms.

Some drill tools permit switching between a drill mode, a hammer mode, or a hammer and drill mode. These different operational modes are useful for drilling into different materials. Such drills are often already being used for drilling holes to set anchors. The existence of a hammering mode enables a method of setting the anchor with the drill tool instead of with a separate punch and hammer.

Figure 6:
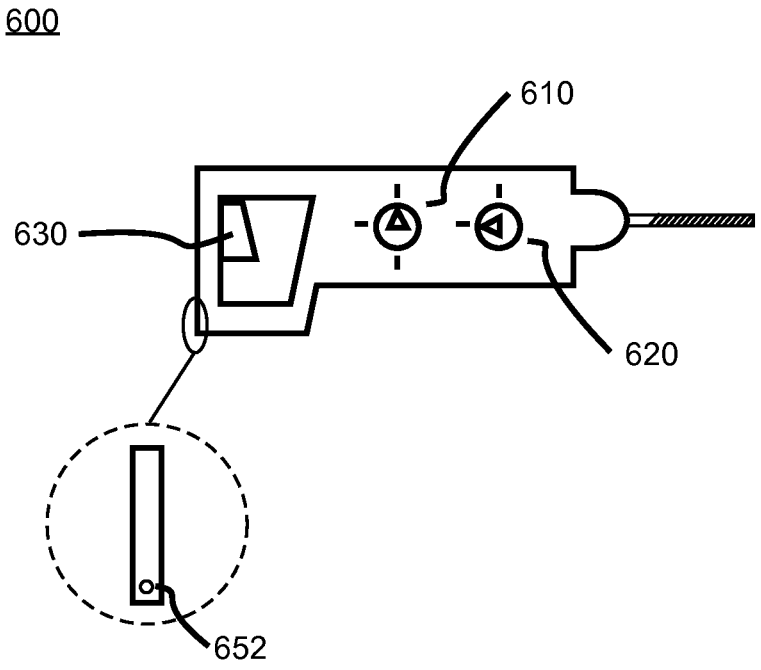
FIG. 6 illustrates one embodiment of a hammer drill.

FIG. 6 illustrates one embodiment of a hammer drill 600. The hammer drill includes controls for selecting operational mode 610, direction of rotation when drilling 620, and speed of drilling or hammer action 630. The illustrated embodiment includes a port 652 to enable electrical signaling to control one or more of these control parameters. For convenience the port may be referred to as a "remote control port".

The control for a typical hammer drill or rotary hammer consists of switches for controlling operational mode (e.g., hammer and drill, hammer only, or drill only) and direction of rotation (clockwise/counter-clockwise). The speed of the hammering action or drill rotation is controlled by a trigger-style throttle. With reference to FIG. 5, in one embodiment, the control actuator 530 is mechanically linked to the drill tool throttle to control the speed of the drill or hammer action.

In an alternative embodiment, the drill tool's control 552 includes an electrical port (see, e.g., port 652 of FIG. 6) for remote control of the drill tool 550 through remote signaling. In one embodiment, the control actuator is electrically linked to the electrical port to control the operational speed of the drill tool. In alternative embodiments, the control actuator is electrically linked to control the operational speed and operational mode of the drill tool.

Figure 7:
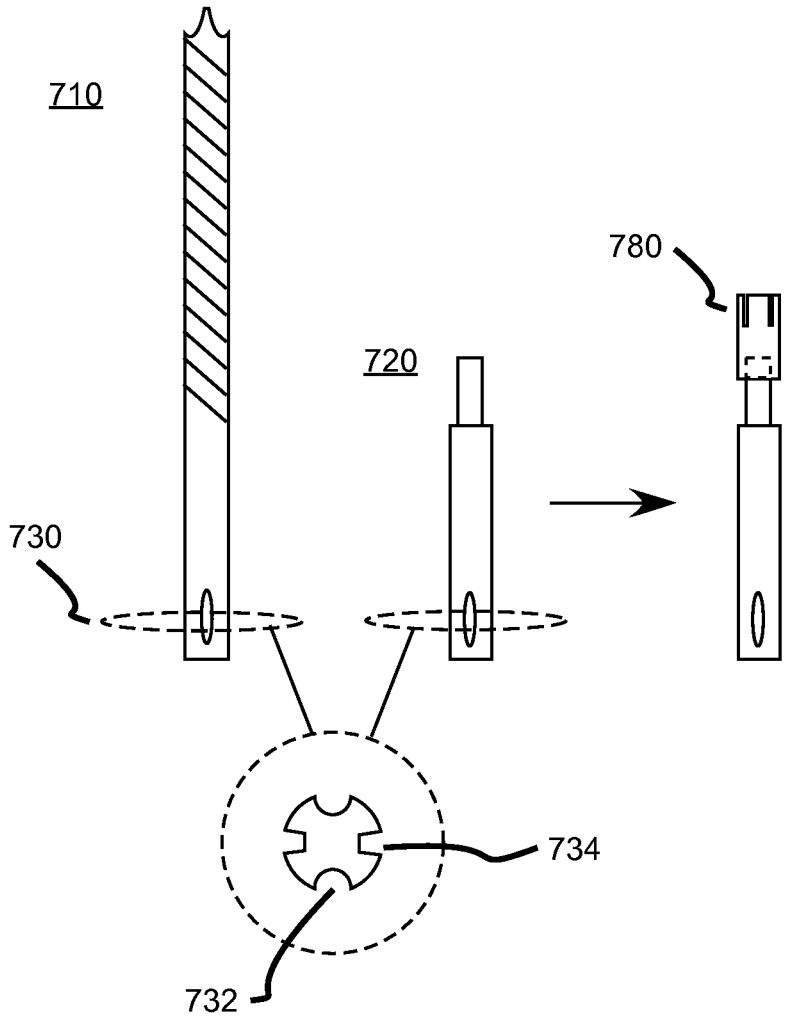
FIG. 7 illustrates an anchor set bit ("punch") for use with the hammer drill and placement of an expansion anchor on the punch.

FIG. 7 illustrates one embodiment of a drill bit 710 and an anchor set bit ("punch") 720 for use with the hammer drill. In the illustrated embodiment the drill bit is designed for removing the material the anchor will be set in (e.g., concrete). The expansion anchor 780 is placed on the anchor set bit 720. The operator may then utilize the arm to deposit the expansion anchor within the drilled hole and then control the drill tool to set the anchor. This may be accomplished, for example, by placing the drill tool in a hammer mode or hammer and drill mode and activating the control actuator to cause the drill tool to strike the expansion plug of the anchor.

In one embodiment the shank of the anchor set bit or punch 720 has features to support SDS compatibility. SDS is a well known standard that supports the use of spring loaded drill chucks. The shank is pushed into the spring loaded chuck and retained by spring loaded pins engaging the rounded depressions in the shank. The chuck also has splines for engaging channeled grooves in the shank. The splines turn the bit when operating in drill mode. The channeled grooves allow the bit to slide longitudinally in hammer mode. A cross section 730 of the shank illustrates the cross section of the rounded depression 732 and the channeled grooves 734.

Figure 8:
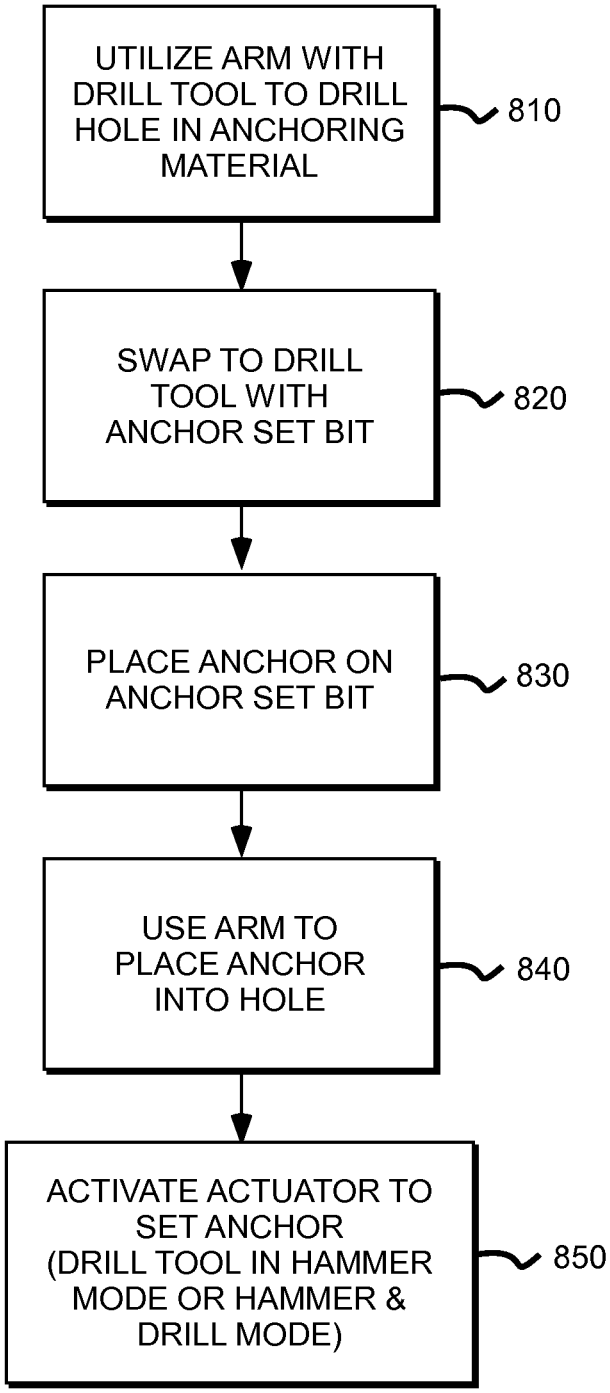
FIG. 8 illustrates one embodiment of a method of using the apparatus of FIG. 5 for anchor placement and setting.

FIG. 8 illustrates one embodiment of a process of utilizing the apparatus described with respect to FIG. 5 for anchor placement and setting. In step 810, the arm with drill tool is used to drill a hole in the anchoring material. The anchoring material may be concrete or brick, for example. The arm enables an operator to remain on the ground while drilling a hole in a ceiling above the operator.

After the hole is drilled the operator swaps to a drill tool with the anchor set bit in step 820. The operator could switch to a different drill tool having the anchor set bit. Alternatively the operator could swap the drill bit for an anchor set bit in the same drill tool. The anchor is this placed on the anchor set bit in step 830. The operator uses the arm to place the anchor into the hole in step 840. Finally, the operator activates the actuator to set the anchor in step 850. The drill tool is set into either hammer mode or hammer and drill mode so that activation results in the anchor set bit setting the anchor.

Figure 9:
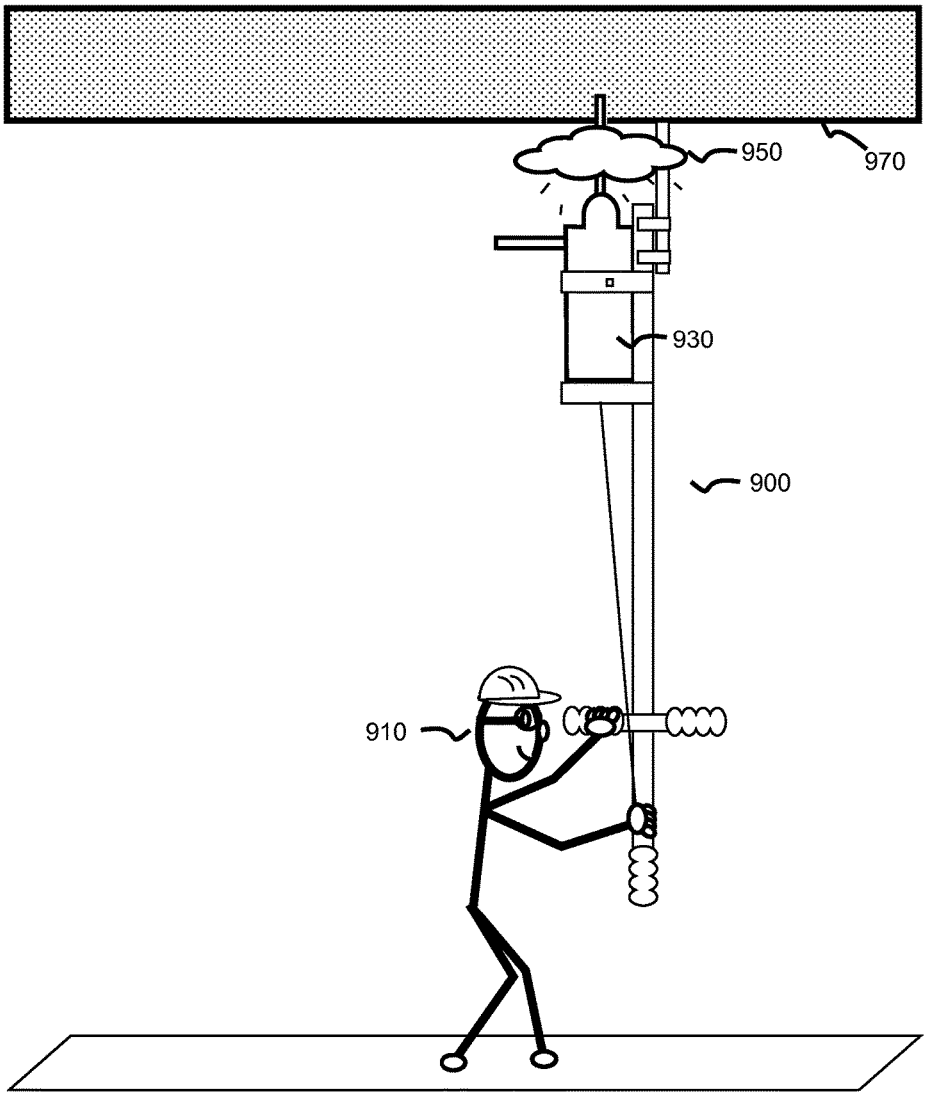
FIG. 9 illustrates an operator using the apparatus of FIG. 5.

FIG. 9 illustrates an operator using the apparatus of FIG. 5. The apparatus 900 enables the operator 910 to reduce the likelihood that the operator will be subjected to harmful debris 950 when drilling into the ceiling 970. The drill tool 930 and arm apparatus 900 scale are exaggerated for purposes of illustration. After drilling the hole in the ceiling, the operator may change the drill tool bit to a setting tool, place the drill tool in "hammer" or "hammer and drill" mode, and place and set the anchor with the apparatus 900. Ideally, the operator can dispense with the use of a ladder altogether for both the placement and setting of the anchor.

Although illustrated with particular detail to the "drop in" expansion anchor, the anchor placement apparatus and method of installing anchors may be utilized in whole or part with other types of anchors.

In the preceding detailed description, the invention is described with reference to specific exemplary embodiments thereof. Methods and apparatus for setting an anchor are described. Various modifications and changes may be made thereto without departing from the broader scope of the invention as set forth in the claims. The specification and drawings are, accordingly, to be regarded in an illustrative rather than a restrictive sense.

What is claimed is:

1. An anchor setting apparatus comprising:

an arm;

a holster for carrying a drill tool;

a drill stop;

a control actuator, wherein the holster and drill stop are coupled proximate one end of the arm, wherein the control actuator is coupled proximate another end of the arm; and linkage for coupling the control actuator to a port of the drill tool, wherein the port receives electrical signals for controlling a speed of operation of the drill tool.

2. The apparatus of claim 1 wherein the arm has an extendible length.

3. The apparatus of claim 1 wherein the arm has a fixed length.

4. The apparatus of claim 1 wherein the longitudinal position of the holster along the arm may be varied.

5. The apparatus of claim 1 wherein the longitudinal position of the drill stop along the arm may be varied.

6. The apparatus of claim 1 wherein the longitudinal position of the drill stop relative to the holster is variable.

7. The apparatus of claim 1 wherein the port enables selection of a direction of rotation of the drill tool.

8. The apparatus of claim 1 wherein the port enables selection of an operational mode of the drill tool.

9. The apparatus of claim 8 wherein the operational mode is one of a drill mode and a hammer mode.

10. The apparatus of claim 1 wherein the drill tool is an electric drill.

11. The apparatus of claim 1 wherein the drill tool is an electric hammer drill.

12. The apparatus of claim 1 wherein the drill tool is an electric rotary hammer.

13. The apparatus of claim 1 wherein the holster is carrying one of an electric hammer drill and an electric rotary hammer.

* * * * *